US005860875A

United States Patent [19]

McKoon et al.

[11] Patent Number: 5,860,875

[45] Date of Patent: Jan. 19, 1999

[54] DUAL SHAFT PUTTER

[76] Inventors: Carl T. McKoon, 1521 Knightsbridge Ct., Winston-Salem, N.C. 27127; Michael T. McKoon, 321 White Oak Dr., Henderson, N.C. 27536

[21] Appl. No.: 966,726

[22] Filed: Nov. 10, 1997

[51] Int. Cl.[6] ..... A63B 69/36; A63B 53/14

[52] U.S. Cl. ..... 473/294; 473/313; 473/314; 473/316

[58] Field of Search ..... 473/294, 251, 473/313, 314, 316, 292

[56] References Cited

U.S. PATENT DOCUMENTS

| | | | |
|---|---|---|---|
| 2,204,974 | 6/1940 | Strasser | 473/294 |
| 3,529,826 | 9/1970 | Hulyk . | |
| 4,215,860 | 8/1980 | Nakamatsu | 473/294 |
| 4,795,153 | 1/1989 | Thomas | 473/316 |
| 5,209,475 | 5/1993 | Loman | 473/294 |
| 5,308,073 | 5/1994 | McKoon | 473/294 |
| 5,553,858 | 9/1996 | McKoon | 473/294 |
| 5,647,806 | 7/1997 | McDevitt | 473/314 |

*Primary Examiner*—Sebastiano Passaniti
*Attorney, Agent, or Firm*—Rhodes, Coats, & Bennett, LLP

[57] ABSTRACT

The present invention entails a dual shaft putter having a putting head and a pair of shafts extending generally upwardly therefrom. The shafts include lower sections that are secured to the putter head in general transverse alignment. In addition, the shafts include upper parallel sections which lie in a plane, that when extended downwardly, intersects the center of mass of the putting head.

14 Claims, 4 Drawing Sheets

DUAL SHAFT PUTTER

FIELD OF THE INVENTION

The present invention relates to the design of golf clubs and more particularly to the design of a putter having dual shafts.

BACKGROUND OF THE INVENTION

Over the years, the sport of golf has continuously grown in popularity, and at present the sport is attracting new players at record pace. This rapid growth has particularly increased membership in the ranks of novice to intermediate players, which generally desire to improve the their skill level so as to become better players and be more competitive on the golf course.

The nature and numerous subtle facets of golf present the amateur player with a daunting list of skills to build and refine. One aspect of the game in particular, putting, tends to be a problem area for many individuals who play the game. In response to the problematic nature of the putting game for so many golfers, there have been a number of innovations involving putter designs, all with the general intent of improving a player's putting game. One of the most widely accepted theories of putting teaches that it is desirable for the underlying mechanics of the putting stroke to mimic that of a simple mechanical pendulum. Of particular interest and relevance, with regard to this objective, is the advent of dual shafted putters such as those previously disclosed in U.S. Pat. Nos. 5,308,073 and 5,553,858. As discussed in these patents, the fundamental advantage of a dual shafted putter design involves the ease with which it facilitates and promotes a true pendulum type putting stroke. This ability is directly attributable to the fact that the use of a separate shaft for each gripping hand greatly reduces the tendency of the golfer's wrists to break during the normal course of a putting stroke. Hence, the ability to prevent or reduce wrist breaking tendency during a typical putting stroke will likely lead to a more accurate and a generally more consistent putting game.

While the use of dual shafts can certainly reduce the tendency towards wrist breakage, there are other considerations in the design of a putter which can also affect its efficiency. Balance of the club with respect to the putting face, for instance, directly affects the ability of the club to resist rotation upon striking a golf ball, and hence reduces the tendency for the ball to be pushed or pulled from the intended course.

From the perspective of an improvement minded golfer, a putter design which maximizes or optimizes this inherent property of the club which helps resist the wrist breaking tendency during a putting stroke is highly desirable. Therefore, there is and continues to be need for a practical and economical putter which optimally assists the golfer in maintaining proper wrists orientation during a typical putting stroke for the purpose of helping the golfer attain and reap the benefits of a true pendulum type putting swing.

SUMMARY OF THE INVENTION

The present invention entails a dual shaft putter that is face balanced. Furthermore, the club is relatively simple in design and consequently can be manufactured economically. Generally, the putter of the present invention comprises a club head having a putting face, and a pair of generally parallel shafts which are secured to the club head in transverse alignment relative to a longitudinal axis of the club head. As a consequence of careful shaping, weighting, and orientation of the above mentioned club components, when assembled and balanced horizontally at a point on one shaft, such that the shafts overlie one another, the face of the club head will assume and maintain a horizontal position. The ability of the club head face to assume and maintain such an orientation, when balanced in the manner described, indicates that the putter is face balanced.

Also, another feature of applicant's dual shaft putter entails securing the respective shafts in transverse alignment relative to the longitudinal axis of the club head of the putter. More particularly, the club head includes a heel portion and the two shafts that are connected to the putter head are connected in general transverse alignment as opposed, for example, to being connected in alignment with the longitudinal axis of the putter head. By the shafts being connected in transverse alignment, the putter head is more easily controlled and generally resists twisting upon impact with the golf ball which can result in the golf ball being pushed or pulled with respect to a target line.

In one particular embodiment, the putting club of the present invention comprises a club head having a putting face, a heel portion, a toe portion, longitudinal axis, and a center of mass. The putting club is further comprised of a pair of generally parallel shafts which are configured so as to have a lower section and an upper section. The lower section of the shafts are secured to the heel portion of the club head in transverse alignment relative to the longitudinal axis of the club head, with each of the lower sections extending from the club head generally upwardly, outwardly, and toward the toe portion, while the upper sections extend generally upward from the lower sections but are angled so as to extend back over the heel portion of the club head. Furthermore, the upper sections of the shafts are disposed in generally parallel relationship and define a plane that, when projected downward, generally intercepts the center of mass of the club head. As a consequence of these structural and material properties, when assembled and balanced horizontally at a point on one shaft, such that the shafts overlie one another, the face of the club head will assume and maintain a horizontal position, thus indicating it's inherent face balanced character.

It is therefore an object of the present invention to provide a face balanced putter that is relatively simple in design, and which can be manufactured economically.

Other objects and advantages of the present invention will become apparent and obvious from a study of the following description and the accompanying drawings which are merely illustrative of such invention.

DESCRIPTION OF THE INVENTION

Figure 1:
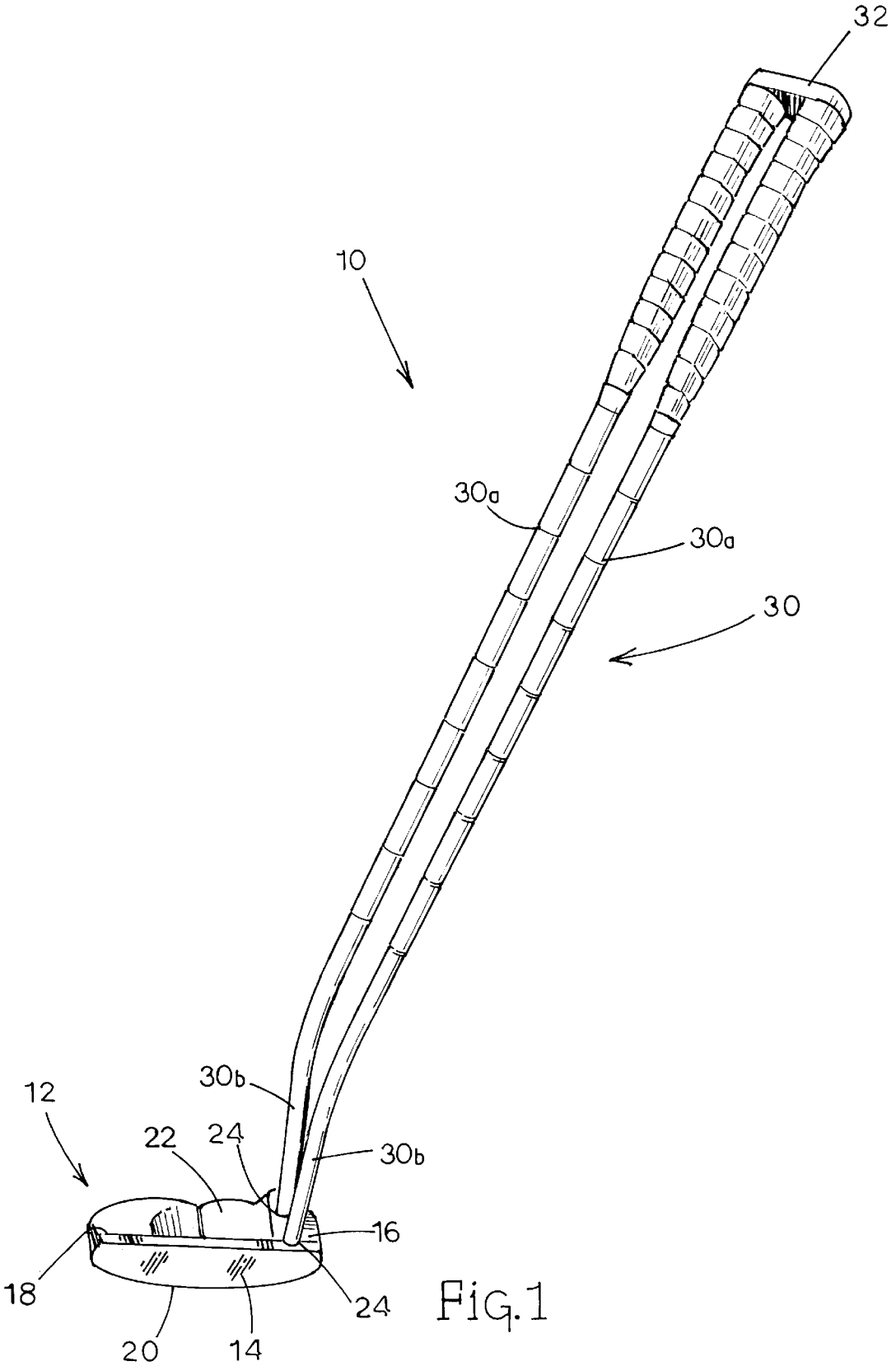
FIG. 1 is a perspective view of the dual shaft, face balanced putter of the present invention.
Figure 4:
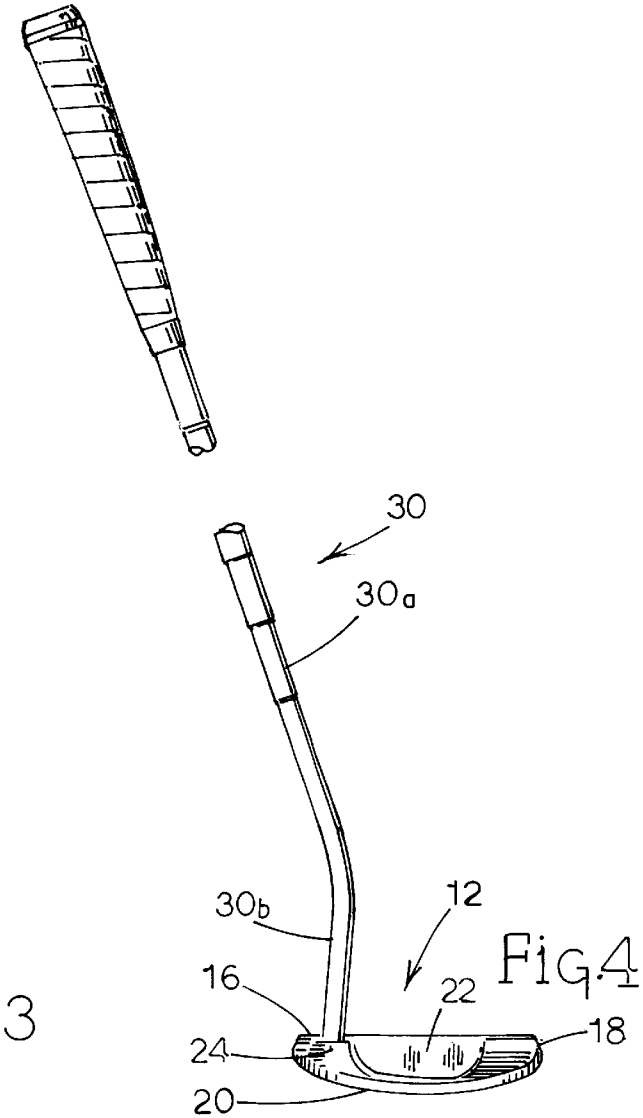
FIG. 4 is a rear elevational view of the putter of the present invention.

According to the present invention, a dual shaft, face balanced putter is shown in FIGS. 1–8 and indicated generally by the numeral 10 therein. The putter 10 comprises a putter head generally indicated by the numeral 12, which includes a putting face 14 for striking a golf ball, a heel region 16, toe region 18, and a sole 20. Disposed generally behind the putting face 14 and extending between the heel and toe regions 16 and 18 is a back cavity 22. As shown specifically in FIGS. 1, 5 and 7, formed in the heel region 16 of the putter head 12 are a pair of shaft appetures 24 which are disposed transversely to a longitudinal axis 26, wherein this longitudinal axis 26 extends generally between the heel and toe regions 16 and 18 of the putter head 12. Also contained within the putter head 12 is an imaginary region referred to as the center of mass 28, shown specifically in FIG. 5, which is a function of the material and geometric shape of the putter head 12.

Figure 3:
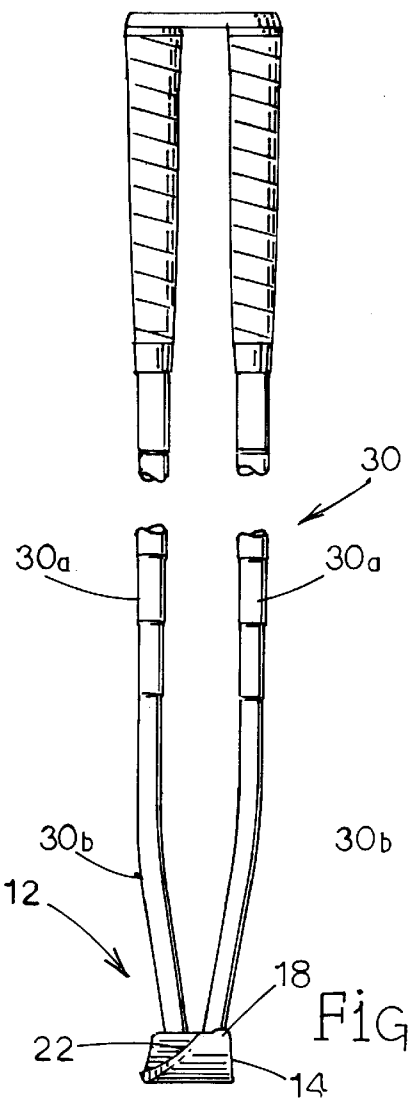
FIG. 3 is a side elevational view of the putter of the present invention illustrating the general parallel relationship of the two shafts, and their generally transverse alignment at the point of attachment on the club head.
Figure 2:
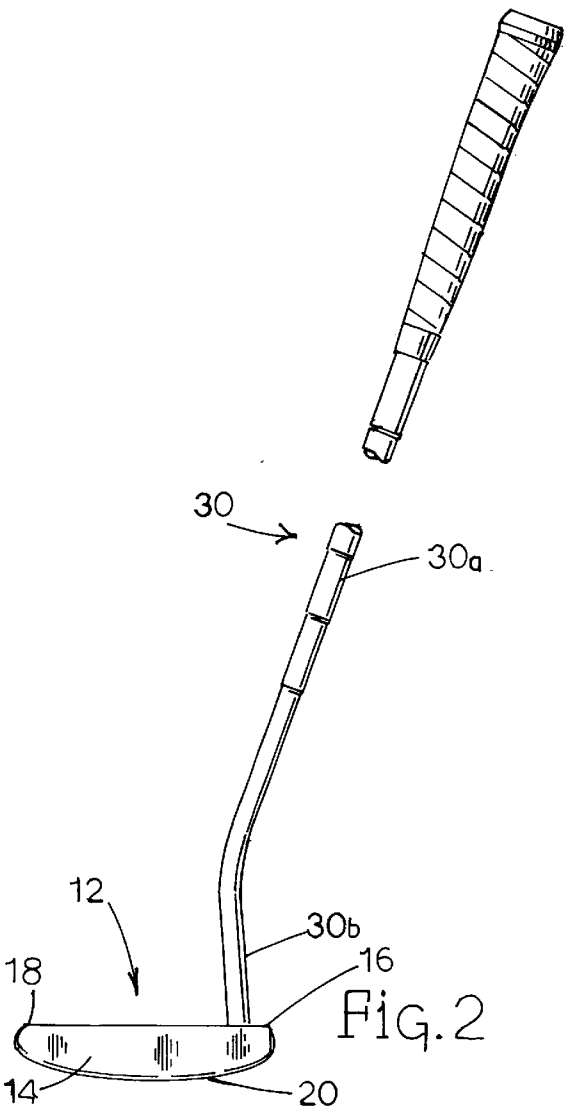
FIG. 2 is a front elevational view of the putter of the present invention showing the club head putting face and generally illustrating the angled nature of the shafts relative the club head.
Figure 5:
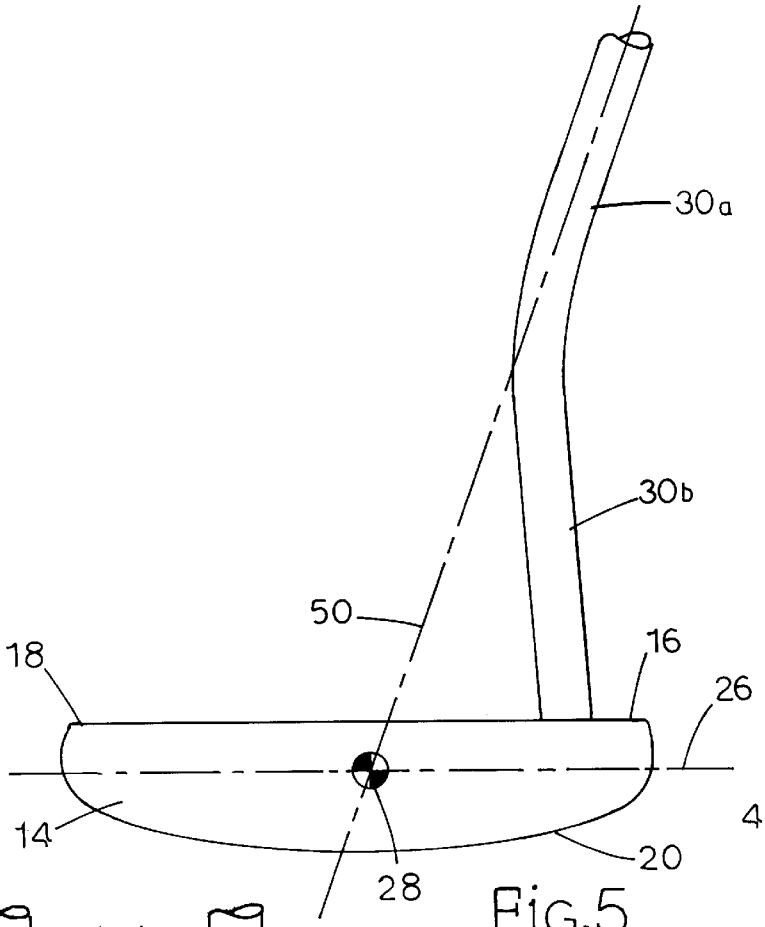
FIG. 5 is a partial front elevational view of the putter of the present invention generally illustrating the longitudinal axis of the club head and the plane formed by the upper shaft sections that, when projected downwardly, intersects the center of mass of the club head.

Putter 10 further comprises a pair of spread apart shafts 30, each of which contain an upper main section 30*a* and a lower main section 30*b,* as shown in FIGS. 1–4. Each shaft 30 is formed such that the upper main section 30*a* and lower main section 30*b* are generally angled with respect to one another. The upper main sections 30*a* of the shafts 30 are adapted to receive a connector 32, which serves to connect and maintain a constant spatial separation of the individual shafts 30 as illustrated in FIG. 3. Also as illustrated in the drawings, the upper sections 30*a* of the shafts 30 include a conventional hand grip.

Figure 7:
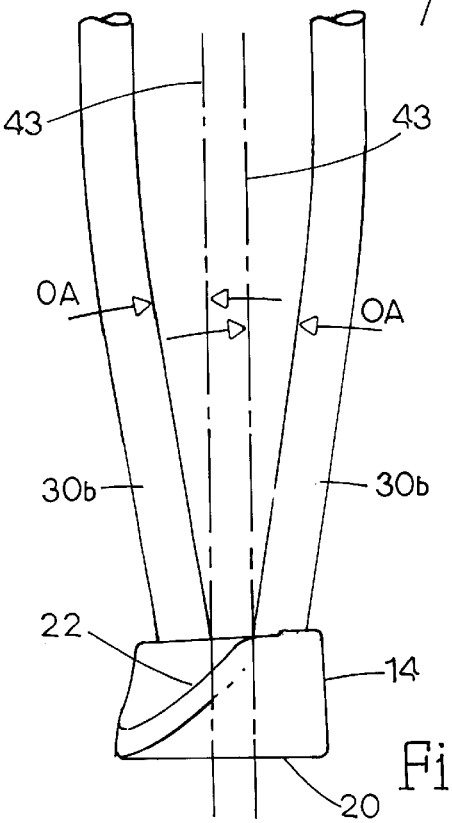
FIG. 7 is a partial side elevational view of the putter of the present invention generally illustrating the outer angles formed by the lower sections of shafts.

When assembled, the lower main sections 30*b* of the shafts 30 are secured within the shaft appetures 24 formed in the heel region 16 of the putter head 12. As a consequence of the transverse positioning of the appeture pair 24 with respect to the longitudinal axis 26 of the putter head 12, the secured shafts 30 extend from the putter head 12 in an orientation that is also generally transverse to the longitudinal axis 26 of the putter head 12 as shown in FIGS. 3 and 7.

Figure 6:
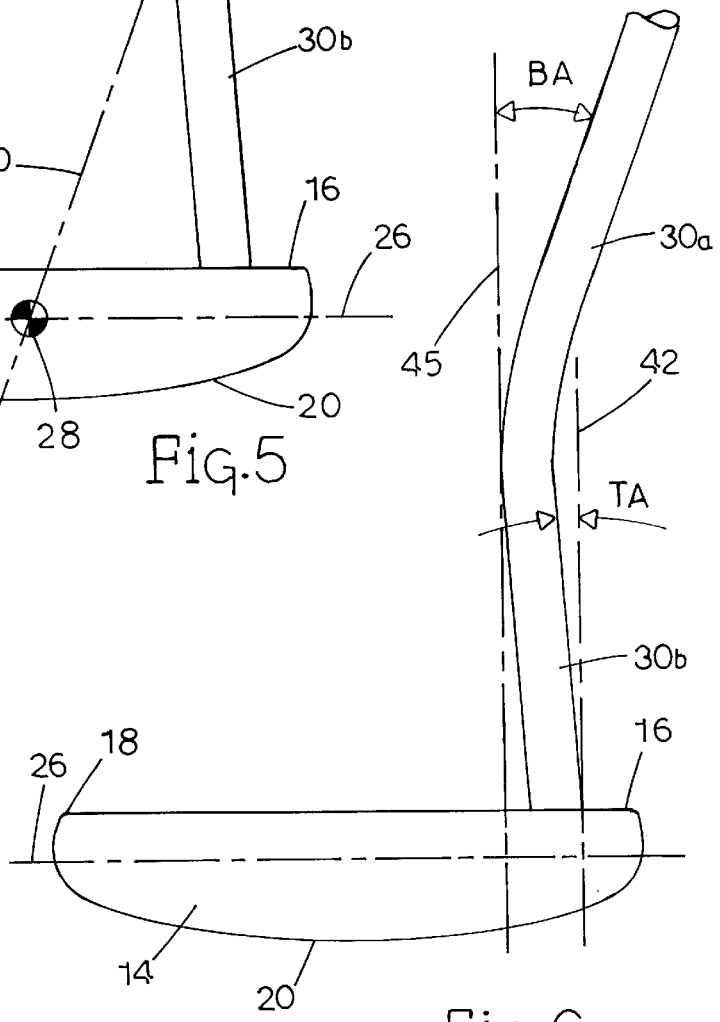
FIG. 6 is a partial front elevational view of the putter of the present invention generally illustrating the toe and back angles formed by the lower and upper sections of the shafts.

As depicted in FIG. 6, the lower main sections 30*b* of the shafts 30 are disposed relative the putter head 12 in such a manner so as to generally extend upwardly and towards the toe region 18 of the putter head 12. In doing so, the lower main sections 30*b* form a toe angle TA with respect to a normal reference line 42 projected upwardly from the heel region 16. In addition to extending upwardly and towards the toe region 18, the lower main sections 30*b* also extend outwardly with one shaft oriented so as to extend outward and generally away from the putter face 14 while the other shaft extends outward and generally away from the back cavity 22, as seen in FIG. 7. As a consequence of this orientation, each of the lower main sections 30*b* form an outer angle OA with respect to the normal reference 43 projected upwardly from the heel region 16. Reference line 43 and the other reference lines referred to herein are shown normal to the longitudinal axis 26.

As shown in FIG. 6, the upper main sections 30*a* of the shafts 30 are also angled with respect to the normal reference line 45 projected upwardly from the heel region 16. In this case, the upper main sections 30*a* extend generally upwardly and back over the heel region 16 of the putter head 12. The angle formed between the normal reference line 45 and the upper main section 30*a* is referred to as a back angle BA. In practice, this back angle BA is formed so as orient the upper main sections 30*a* in such a manner that a plane 50 (FIG. 5) formed by the two upper main sections 30*a,* when projected downwardly towards to putter head 12, generally intersects the center of mass 28 of the putter head 12. By doing such, the putter 10 is said to be faced balanced, that is, balanced with respect to the face 14 of the putter head 12.

Figure 8:
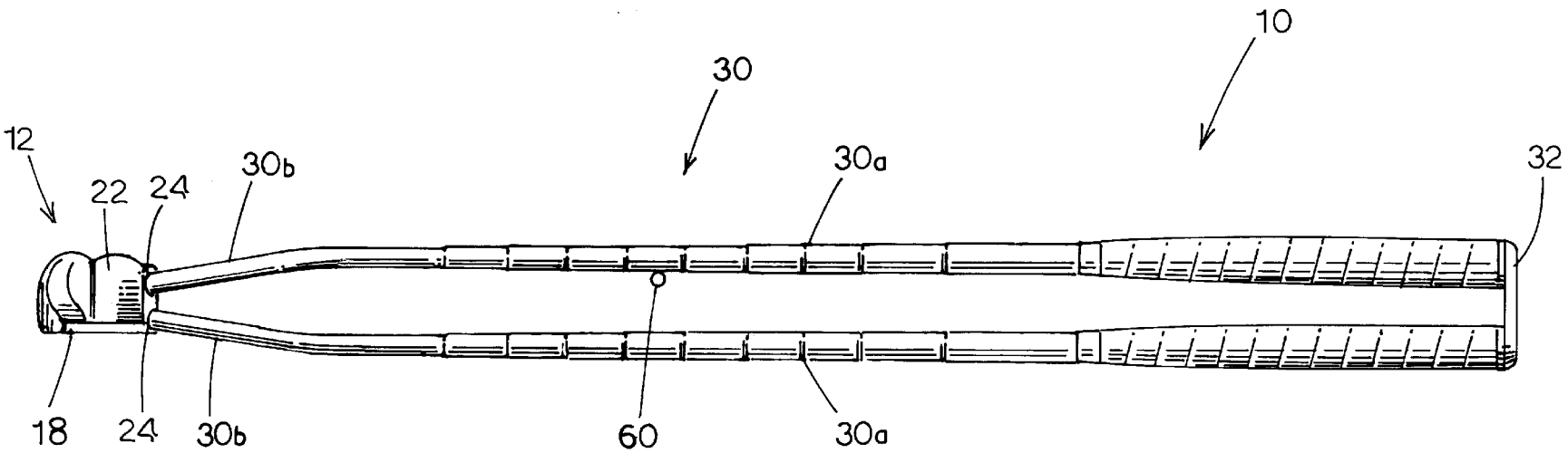
FIG. 8 is an elevational view of the putter of the present invention showing the putter balanced in such a manner so as to demonstrate it's face balanced property.

FIG. 8 illustrates a practical demonstration of the face balanced property described above. In this case, the putter 10 is balanced horizontally at a fulcrum point 60 on one of the shafts 30 such that the shafts 30 overlie each other. Once balanced in this manner, the putter head 12 will assume and maintain a horizontal position, thereby indicating that the face 14 of the putter head 12 is balanced.

Therefore, based on the above discussion and associated drawings, it is appreciated that there are several design factors which influence the face balanced property of the putter 10. These factors include, but are not limited to, the shape and weight of the putter head 12, the shape, weight and relative orientation of the shafts 30, and the position and relative orientation of the shaft appetures 24 on the putter head 12. In the way of examples, the putter 10 of the present invention utilizes a pair of shafts 30 wherein the upper main sections 30*a* are generally parallel. Furthermore the shafts 30 attach to the putter head 12 in a generally transverse orientation about the heel portion 16, with a toe angle TA of approximately 7–13 degrees, an outer angle OA of approximately 2–8 degrees, and a back angle BA of approximately 15–25 degrees.

In the case of the present putter design, it has been found that a putter having the above design and characteristics will yield a face balanced putter. Again, the face balance property being discussed herein is basically illustrated in FIG. 8. There, the putter 10 is oriented horizontally with one shaft 30 being disposed over the other shaft 30. The entire putter 10 is balanced by the fulcrum point 60 resting appropriately under one of the shafts 30 such that the entire putter 10 remains generally horizontal. Once this is achieved, the entire putter head 12 also remains generally horizontal. That is, the putter head 12 does not rotate under these circumstances such that it extends generally up and down. The putter head 12 remains generally horizontal.

In addition, as already discussed, the plane of the upper sections 30*a* of the shafts 30 when projected downwardly intersects the center of mass 28 of the putter head 12. That indicates that the putter head 12 is generally balanced and in the case of the present invention, is balanced such that the central ball striking area of the putter face 14 is aligned with the center of mass 28 of the putter head 12. This is to be contrasted with some putters wherein the club head or putter face is not balanced, but where the center of mass is disposed in an offset relationship so as to reside at or near the toe or heel portions of the club.

The advantage of the putter 10 of the present invention is that by utilizing the dual shaft 30 and balancing the putter head 12 in the matter described above, the putter 10 does not have an inherent tendency to rotate when the club face 14 strikes the golf ball in the central area thereof. Thus, this assists the golfer in putting the golf ball along a target line as opposed to the club head having a tendency to twist and angle such that the golf ball is either pushed or pulled relative to the target line.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A dual shaft, face balanced golf putter comprising: a club head having a putting face; a pair of shafts secured to the club head and extending therefrom in a general spread apart relationship; and wherein the club head includes a center of mass and wherein each of the shafts include an upper section and wherein the upper sections of the shafts are disposed in general parallel relationship and lie generally within a plane that when projected downward generally intercepts the center of mass of the club head; and wherein the club head and shafts are shaped, weighted, and oriented with respect to each other so that when assembled and balanced horizontally at a point on one shaft such that the shafts overlie each other, the club head will assume and maintain a horizontal position, thereby indicating that the face of the club head is balanced.

2. The golf putter of claim 1 wherein the club head includes a longitudinal axis and wherein the shafts are secured to the club head generally transversely about the longitudinal axis.

3. The golf putter of claim 2 wherein the shafts are secured to the club head in transverse alignment.

4. The golf putter of claim 1 wherein the club head includes heel and toe portions and wherein each shaft includes upper and lower sections and wherein the lower sections are secured to the club head generally transversely relative to a longitudinal axis with each of the lower sections extending from the club head generally upwardly, outwardly, and toward to the toe portion; and wherein the upper sections extend generally upward from the lower sections but are angled so as to extend back over the heel portion of the club head.

5. The golf putter of claim 4 wherein the upper sections extends in general parallel relationship.

6. The golf putter of claim 5 wherein the lower section forms outer and toe angles with respect to the club head and wherein the outer angle is approximately 2–8 degrees while the toe angle is approximately 7–13 degrees.

7. The golf putter of claim 6 wherein the upper sections form a back angle with respect to a normal reference line of approximately 15–25 degrees.

8. A golf putter comprising: a club head having a putting face, heel portion, toe portion; a pair of transversely aligned shaft appetures formed in the heel section; a pair of spread apart shafts secured to the club head, each shaft including a lower section secured within a respective appeture such that the lower sections of the shafts are secured in general transverse alignment to the longitudinal axis of the club head; and wherein the club head includes a center of mass and wherein each of the shafts include an upper section and wherein the upper sections of the shafts are disposed in general parallel relationship and lie generally within a plane that when projected downward generally intercepts the center of mass of the club head.

9. The golf putter of claim 8 wherein the golf putter is face balanced.

10. The golf putter of claim 8 wherein the club head includes heel and toe portions and wherein each shaft includes upper and lower sections and wherein the lower sections are secured to the club head generally transversely relative to a longitudinal axis with each of the lower sections extending from the club head generally upwardly, outwardly, and toward to the toe portion; and wherein the upper sections extend generally upward from the lower sections but are angled so as to extend back over the heel portion of the club head.

11. The golf putter of claim 10 wherein the lower sections form outer and toe angles with respect to the club head and wherein the outer angle is approximately 2–8 degrees while the toe angle is approximately 7–13 degrees, and wherein the upper sections form a back angle with respect to a normal reference line and wherein the back angle is approximately 15–25 degrees.

12. A golf putter comprising: a club head having a putting face, heel portion, toe portion, and a center of mass; a pair of shafts secured to the club head and extending therefrom, each shaft including upper and lower sections with the lower section being secured to the club head and extending generally upwardly therefrom in such a manner that the lower sections extend outwardly and toward the toe portion of the club head; the upper sections extending from the lower sections such that they project and extend back over and past the heel portion, and wherein the upper sections lie in general parallel relationship and in a plane that if projected downwardly intercepts the center of mass of the club head; and wherein the club head and shafts are shaped, weighted, and oriented with respect to each other so that when assembled and balanced horizontally at a point on the shaft such that the shafts overlie each other, the club head will assume and maintain a horizontal position, thereby indicating that the face of the club head is balanced.

13. The golf putter of claim 12 wherein the lower sections of the shafts are secured to the club head generally transversely relative to a longitudinal axis of the club head.

14. The golf putter of claim 13 wherein the lower sections form outer and toe angles with respect to the club head and wherein the outer angle is approximately 05 degrees while the toe angle is approximately 10 degrees, and wherein the upper sections form a back angle with respect to a normal reference line and wherein the back angle is approximately 18–19 degrees.

* * * * *